United States Patent [19]

Vance

[11] Patent Number: 4,865,204

[45] Date of Patent: Sep. 12, 1989

[54] CARTON STRUCTURE HAVING EASILY OPENABLE COMPRESSION RESISTANT END

[75] Inventor: Gerald E. Vance, Cincinnati, Ohio

[73] Assignee: The Procter & Gamble Company, Cinninnati, Ohio

[21] Appl. No.: 460,527

[22] Filed: Jan. 24, 1983

[51] Int. Cl.[4] ..... B65D 5/54

[52] U.S. Cl. ..... 206/625; 206/629; 206/631.1

[58] Field of Search ..... 206/625, 626, 629, 630, 206/631, 634, 607, 622; 229/17 B, 44 R, 43, 44 C

[56] References Cited

U.S. PATENT DOCUMENTS

| | | | |
|---|---|---|---|
| 1,717,367 | 6/1929 | Byrne | 206/626 |
| 1,940,849 | 12/1933 | Davidson | 206/626 |
| 1,992,195 | 2/1935 | Daller . | |
| 2,002,364 | 5/1935 | Daller | 206/622 |
| 2,003,925 | 6/1935 | Daller . | |
| 2,007,520 | 7/1935 | Daller | 206/630 |
| 2,039,437 | 5/1936 | Moore | 206/626 |
| 2,124,868 | 7/1938 | Davidson . | |
| 2,249,244 | 7/1941 | Guyer | 206/625 |
| 2,260,137 | 10/1941 | Donnelly | 206/622 |
| 2,275,134 | 3/1942 | Davidson | 206/626 |
| 3,093,292 | 6/1963 | Ahlbor | 206/625 |
| 3,302,857 | 2/1967 | Martin . | |
| 3,326,364 | 6/1967 | Waldrop et al. . | |
| 3,368,739 | 2/1968 | Roccaforte et al. . | |
| 3,438,565 | 4/1969 | Lugt et al. | 206/626 |
| 3,438,566 | 8/1969 | Mahon . | |
| 3,885,732 | 5/1975 | Foster . | |
| 3,893,614 | 7/1975 | Meyers . | |
| 3,967,774 | 7/1976 | Querner . | |

FOREIGN PATENT DOCUMENTS

| | | | |
|---|---|---|---|
| 758629 | 10/1956 | United Kingdom | 206/622 |

*Primary Examiner*—Bryon P. Gehman

*Attorney, Agent, or Firm*—E. Kelly Linman; John V. Gorman; Richard C. Witte

[57] ABSTRACT

An easily openable carton structure having an end wall including an interior flap hingedly connected to one of the carton side walls, said interior flap having a line of weakness defining shear initiating and non-shear initiating portions thereof and an exterior flap higedly connected to another of said carton side walls secured in overlapping relation to said interior flap. In a particularly preferred embodiment, opening of end of the carton is carried out by lifting upwardly on the hingedly connected edge of the shear initiating portion of the interior flap, thereby causing separation of the secured portion of the exterior flap from the non-shear initiating portion of said interior flap.

19 Claims, 2 Drawing Sheets

CARTON STRUCTURE HAVING EASILY OPENABLE COMPRESSION RESISTANT END

TECHNICAL FIELD

The present invention has relation to carton structures such as are commonly used for packaging many kinds of merchandise.

The present invention has further relation to a carton structure having an easily openable end which may be simply and reliably opened by the ultimate consumer without the need for special tools or appliances, yet which is resistant to the compression loads typically experienced during shipping and handling of the carton.

The present invention has further relation to such a carton structure wherein the easily openable end is provided without utilizing any more material than is typically required to produce a carton structure not having such an easily openable end.

The present invention has further relation to such a carton structure wherein the easily openable end does not adversely affect production speed or efficiency during the erection, filling, closing or sealing phases of the manufacturing operation.

The present invention has further relation to such a carton structure wherein actuation of the easily openable end by the consumer exposes the entire cross section of the carton to permit complete dispensing of the carton's contents.

BACKGROUND ART

Cartons having various types of opening features ar well known in the art.

Exemplary of carton structures having easy opening features provided by lines of weakening in one or more layers of the carton material are the following: U.S. Pat. No. 1,992,195 issued to Daller on Feb. 26, 1935; U.S. Pat. No. 2,003,925 issued to Daller on June 4, 1935; U.S. Pat. No. 3,302,857 issued to Martin on Feb. 7, 1967; U.S. Pat. No. 3,326,364 issued to Waldrop et al. on June 20, 1967; U.S. Pat. No. 3,368,739 issued to Roccaforte et al. on Feb. 13, 1968; U.S. Pat. No. 3,438,566 issued to Mahon on Aug. 15, 1969; U.S. Pat. No. 3,885,732 issued to Foster on May 27, 1975 and U.S. Pat. No. 3,893,614 issued to Meyers on July 8, 1975.

U.S. Pat. No. 2,124,868 issued to Davidson on July 26, 1938 discloses still another prior art carton which allegedly opens easily yet which can be sealed so tightly as to prevent the sifting out of fine or powdered material. Davidson discloses a carton having front, rear and side walls, the side walls having inturned flaps and a top secured to the rear wall and overlying the flaps. The top has a glue strip at each side fixedly secured to the inturned flaps. According to Davidson, the glue strip is limited by a weakened line extending across the top on its underside only, whereby upon opening of the top the material of the glue strips will split and only their underparts will adhere to the inner flaps while the outer surface of the top remains continuous and unbroken.

It is also known in the prior art to provide carton structures having overlapping flaps which are hingedly connected to the front and back walls of the carton, said flaps being securely bonded to one another to provide a sealed, compression resistant end of the carton. To facilitate easy opening by the consumer, it has also been prior art practice to provide removable tear strips extending across the exterior overlapping flap in a direction generally parallel to the front and back walls of the carton. Although these removable tear strips work well from the standpoint of openability, they require precise registration of the adhesive utilized to bond the flaps to one another to prevent bonding of the tear strip. In addition, cartons employing such removable tear strips are oftentimes damaged prior to reaching the consumer due to the compressive loads applied to the front and back surfaces of the cartons when they are shipped and handled. Typically, this results in a prematurely opened carton which, of course, is unacceptable to the consumer.

Accordingly, it is an object of the present invention to provide an improved carton structure having a securely sealed, yet easily openable end.

It is a further object of the present invention to provide such a carton structure wherein the presence of the easy opening end does not significantly detract from the compression resistance of the carton when compressive loads are applied to opposing side wall surfaces of the carton.

It is a further object of the present invention to provide such a carton structure without utilizing any more material than would be required to provide a comparable non-easy opening carton end.

It is still another object of the present invention to provide such a carton structure which is no more difficult to erect, fill, close and seal than a comparable carton which has not been provided with an easy opening end of the present invention.

DISCLOSURE OF THE INVENTION

The present invention, in a particularly preferred embodiment, pertains to a carton structure having end walls and side walls, at least one of said end walls being easily openable yet resistant to compression. The easily openable end wall preferably includes an interior flap having a line of weakness defining shear initiating and non-shear initiating portions thereof. The interior flap has one of its edges hingedly connected to one of the side walls of the carton. The line of weakness preferably extends from the hingedly connected edge of the interior flap in the direction of the opposite edge of said interior flap. The easily openable end also includes an exterior flap hingedly connected to another of the side walls of the carton and secured in overlapping relation to both the shear initiating and the non-shear initiating portions of the interior flap.

When the carton is opened by lifting upwardly on the hingedly connected edge of the shear initiating portion of the interior flap, the shear initiating portion of the interior flap severs along the line of weakness and remains secured to the exterior flap, while separation occurs between the exterior flap and the non-shear initiating portions of the interior flap.

Because those portions of the line of weakness located in the interior flap extend in the same general direction in which compressive loads are typically applied to the package during shipping and handling, the "hinge" effect, which contributes to premature opening when lines of weakness are provided in a direction generally perpendicular to the direction of applied compressive loads, is substantially avoided. Accordingly, the compression resistance of the carton is not significantly impaired when an easy opening end of the present invention is incorporated in the carton.

BRIEF DESCRIPTION OF THE DRAWINGS

While the specification concludes with claims particularly and distinctly claiming the present invention, it is believed the present invention will be better understood from the following description in conjunction with the accompanying drawings in which:

DETAILED DESCRIPTION OF THE INVENTION

Figure 1:
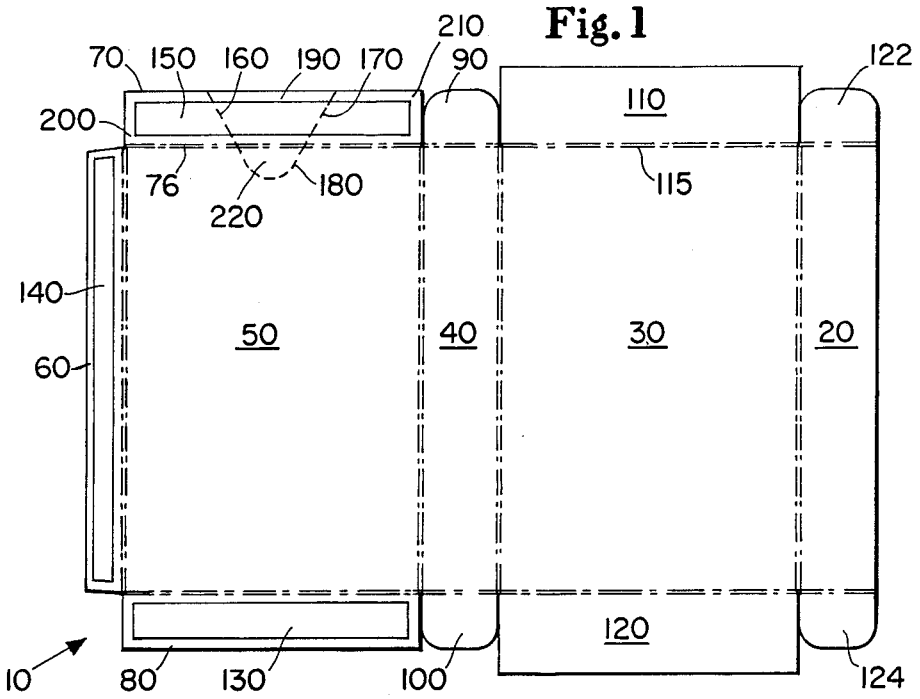
FIG. 1 is a simplified illustration of a carton blank which may be utilized to form a particularly preferred carton structure of the present invention, said blank being shown in a knocked-down-flat condition.

FIG. 1 discloses a knocked-down-flat carton blank 10 which may be utilized to construct a particularly preferred carton structure of the present invention. In particular, the knocked-down-flat carton blank 10, which may be constructed of any of numerous materials well known in the art such as chipboard, solid bleached sulfate, bending newsboard, kraft or clay-coated kraft board, clay-coated chipboard, clay-coated newsboard and the like, includes first edge side wall 20, front side wall 30, second edge side wall 40, rear side wall 50 and overlapping securement tab 60 hingedly connected to one another by means of fold lines defining said side walls in the manner generally disclosed in FIG. 1. The carton blank 10 further includes second edge side wall flaps 90 and 100, first edge side wall flaps 122 and 124, side wall interior flaps 70 and 80 and side wall exterior flaps 110 and 120 hingedly secured along the fold lines illustrated in FIG. 1 to rear side wall 50 and front side wall 30, respectively. While the present invention may be practiced to advantage using a wide range of material thicknesses, the advantages are particularly pronounced with materials having a thickness in the range of about 0.010 inches (0.254 millimeters) and about 0.030 inches (0.762 millimeters).

Securement tab 60 includes an adhesive receiving area 140 which has preferably been specially prepared to receive a bonding adhesive during the assembly operation. This special preparation typically comprises some type of surface roughening such as by the application of a multiplicity of shallow perforation lines or the like in the outermost surface of the carton blank to enhance adhesive bonding. Similar adhesive receiving areas 130 and 150 are also preferably provided in the outermost surface of rear side wall interior flaps 80 and 70, respectively.

As can be seen from FIG. 1, rear side wall interior flap 70 is divided into a centrally located shear initiating portion 190 and non-shear initiating portions 200 and 210 by means of a continuous line of weakness preferably comprising lines of perforation 160 and 170 which span interior flap 70 and line of perforations 180 located in rear side wall 50. In the embodiment illustrated in FIG. 1, line of perforatins 180 serves not only to interconnect lines of perforation 160 and 170 at folding line 76, but also to define a tab 220 in the rear side wall 50 of the carton blank 10. While die cut perforation is preferably employed to create the continuous line of weakness comprising lines of perforation 160, 170 and 180, any method which will produce a predisposed line having a similar degree of weakness in the particular material comprising the carton blank 10 may be used with equal facility.

Figure 2:
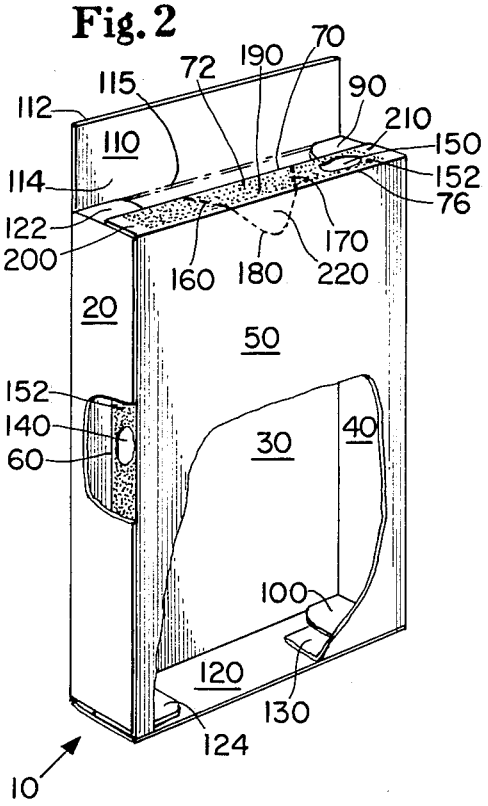
FIG. 2 is a simplified perspective illustration shown with broken out segments to illustrate the manner of assembly of a carton structure formed utilizing the carton blank illustrated in FIG. 1, said carton structure being shown just prior to closing of the exterior flap on the easily openable end of the carton.

FIG. 2 is a simplified perspective illustration of a carton blank 10 of the type disclosed in FIG. 1 shown in an erected condition, but prior to closure and securement of the front side wall exterior flap 110 along the adhesive receiving area 150 of rear side wall interior flap 70 by means of adhesive 152. For ease of illustration, the carton contents have not been shown, and portions of the structure have been broken away to show the assembled relationship of the various carton elements. In particular, the tubular body of the carton is formed by bonding the innermost face of fist edge side wall 20 to the outermost face of securement tab 60 along adhesive receiving area 140 by means of a suitable adhesive 152. Suitable adhesives may be any of various types well known in the art, e.g., resins, hot melts, dextrines, polyvinyl acetates and the like. Exemplary materials include a resin type adhesive available from the H. B. Fuller Company of Cincinnati, Ohio under the designation C-3850; a resin type adhesive available from the Borden Chemical Company of Delaware Ohio under the designation Cascorez E-2348-C; and a hot melt adhesive available from Findley Adhesives, Inc. of Elm Grove, Wis. under the designation 335—335. As will be apparent from FIG. 2, the carton structure is preferably formed by folding the carton blank 10 such that first edge side wall flaps 90 and 100 and second edge side wall flaps 122 and 124 are first folded inwardly, followed by rear side wall interior flaps 70 and 30. Finally, front side wall exterior flaps 110 and 120 are folded inwardly into overlapping relation with rear side wall interior flaps 70 and 130, respectively, as generally shown in FIG. 2.

Front side wall exterior flap 120 is preferably secured to the outermost surface of rear side wall interior flap 80 along adhesive receiving area 130 (generally shown in FIG. 1) by means of a suitable adhesive 152. As can be seen from FIG. 2, the innermost surface 114 of front side wall exterior flap 110 is caused to contact the adhesive 152 present in adhesive receiving area 150 on the outermost surface 72 of rear side wall interior flap 70 when the exterior flap is folded along fold line 115.

Figure 3:
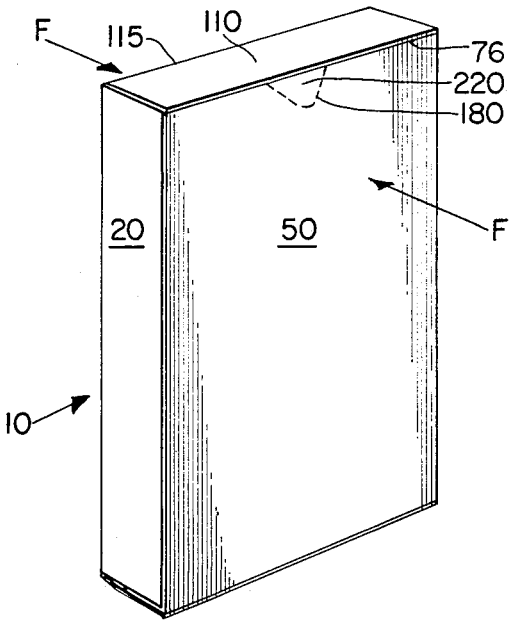
FIG. 3 is a simplified perspective illustration of the carton structure shown in FIG. 2 after sealing of the exterior flap to the interior flap has been effected.

As will also be apparent from FIG. 2, the shear initiating portion 190 of rear side wall interior flap 70 and the non-shear initiating portions 200 and 210 of interior flap 70 are secured to the innermost surface 114 of front side wall exterior flap 110 in those areas coinciding with adhesive receiving area 150 to produce a sealed carton 10, as generally shown in FIG. 3.

As will be appreciated by those skilled in the art, filled and sealed cartons 10 of the type generally shown in FIGS. 1, 2 and 3 are typically handled during case packing, shipping and uncasing operations by the application of opposing compressive forces "F" to their opposing side walls, most typically the front side wall 30 and back side wall 50 of the carton. Experience has demonstrated that compressive loads applied to carton structure of the present invention are substantially as resistant to compression at their uppermost, i.e., their easily openable end as at their lowermost end. While not wishing to be bound by any particular theory of operation, this is believed to be due to the fact that those portions of the line of weakness provided in rear side wall interior flap 70, i.e., lines of perforation 160 and 170, are oriented in a direction generally parallel to the application of most compressive forces "F" to which the carton is subjected. Accordingly, the continuous line of weakness formed by lines of perforation 160 and 170 in interior flap 70 and the interconnecting line of perforations 180 in rear side wall 50 does not form a "hinge" in the end wall in a direction substantially perpendicular to the application of such compressive forces. Thus the predisposition toward buckling of the carton end at the edges of the tear strip typically observed when the tear strip is oriented substantially parallel to the rear side wall 50 of the carton has not been observed in cartons of the present invention.

When it is desired to open a sealed carton 10 of the type shown in FIG. 3, it is necessary only to apply a localized compressive force to the tab 220 defined by line of perforations 180 in the carton's rear side wall 50. This causes the tab 220 to separate along line of perforations 180 to provide a lifting point at which the front side wall exterior flap 110 and the shear initiating portion 190 of interior flap 70 can be firmly grapsed. Exerting an upward force at this lifting point causes the shear initiating portion 190 of rear side wall interior flap 70 to separate from the non-shear initiating portions 200 and 210 along lines of perforation 160 and 170, respectively, as well as to initiate delamination of the interior flap in those areas of the non-shear initiating portions 200, 210 which coincide with adhesive receiving area 150.

Figure 4:
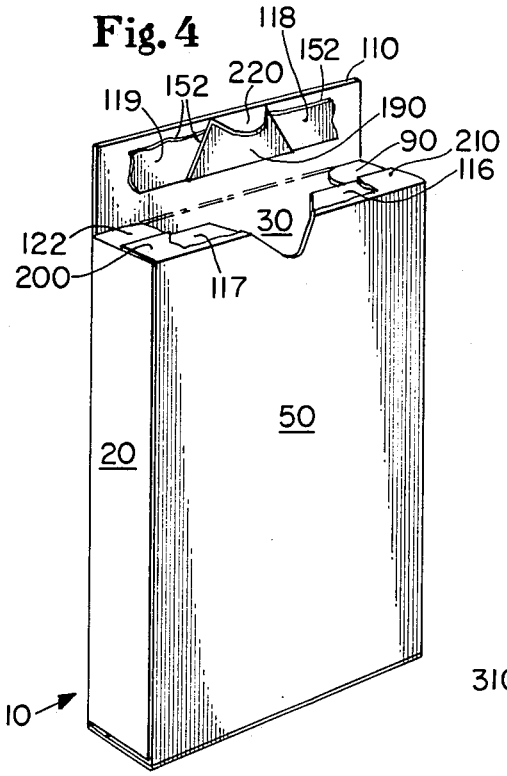
FIG. 4 is a simplified perspective illustration of the carton structure shown in FIG. 3 after opening has been effected by means of the present invention.

The results of the aforementioned lifting action are illustrated in FIG. 4, wherein it can be seen that those non-shear initiating portions 200, 210 of rear side wall interior flap 70 which coincide with adhesive receiving area 150 have delaminated from the outermost surface 72 of interor flap 70 and remain secured to the innermost surface 114 of exterior flap 110 by means of adhesive 152. This leaves recessed areas 116 and 117 in non-shear initiating portions 210 and 200, respectively, of interior flap 70. As will also be observed from FIG. 4, the shear initiating portion 190 of interior flap 70 has become separated (without delamination) from the remainder of the interior flap along that portion of the line of weakness formed by lines of perforation 160 and 170. Thus, in the carton embodiment illustrated in FIGS. 1 through 4, the line of weakness acts to preferentially initiate a shearing action within the non-shear initiating portions 200 and 210 of the interior flap as well as a complete severance of the shear initiating portion 190 from the remainder of the flap.

As will be appreciated by those skilled in the art, separation between front side wall exterior flap 110 and the non-shear initiating portions 200, 210 of interior flap 70 to lwhich it is secured could also be affected at the point of adhesive joinder between the exterior and interior flaps, provided the adhesive 152 initially utilized to join these flaps to one another exhibits a lower resistance to shear than the material of which the carton blank 10 is comprised. In the latter case, no delamination of interior flap 70 would be required to effect opening, merely severance of the shear initiating portion 190 along lines of perforation 160 and 170 and separation of the adhesive 152 in those areas corresponding to the non-shear initiating portions 200, 210 of interior flap 70.

As will also be appreciated by those skilled in the art, since the compression resistance of interior flap 70 is not significantly degraded by the lines of perforation 160 and 170, first edge side wall flaps 90, 100 and second edge side wall flaps 122, 124 may, if desired, be shortened without detracting significantly from the overall compression resistance of the carton end. This in turn results in material savings as well as improved line efficiencies, since different length flaps facilitate better control of the knocked-down-flat carton blanks during the carton erecting operation. By way of contrast, prior art cartons which employ tear strips exhibit a tendency to bend at the edges of the tear strip rather than the flap fold lines during the erection process, thereby making the carton erection process more difficult.

An additional benefit afforded by cartons of the present invention when contrasted to cartons of the prior art which employ tear strips is that the requirement for precise application of the adhesive, which is normally necessary to avoid adhering the tear strip to the carton, is completely eliminated. Thus, unlike prior art tear strip cartons, the reliability with which cartons of the present invention function from an ease of opening standpoint is substantially unaffected by the precision of the gluing operation used to secure exterior flap 110 to interior flap 70.

Figure 5:
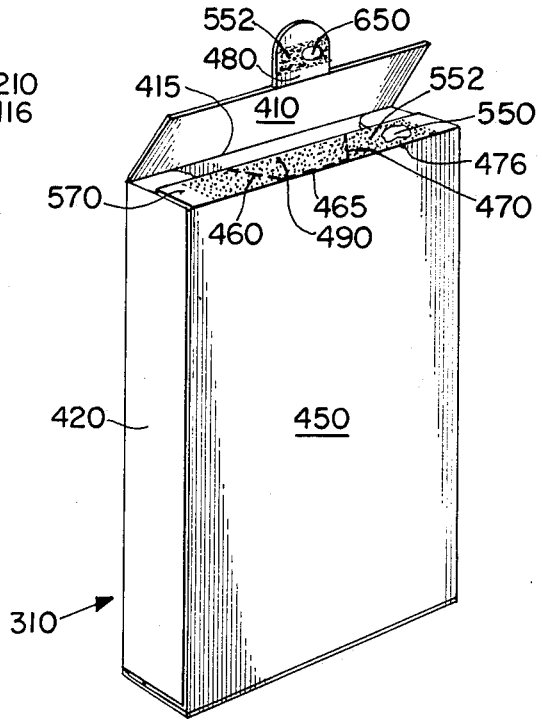
FIG. 5 is a simplfied perspective illustration of an alternative embodiment of the present invention.

It is of course recognized that the present invention may be practiced to advantage in many different forms. The carton embodiment 310 illustrated in FIG. 5 is representative of one such alternative. In particular, a carton generally similar to that shown in FIGS. 1 through 4 is provided with a rear side wall 450, a first edge side wall 420, a front side wall exterior flap 410 and a rear side wall interior flap 570. The front side wall exterior flap 410 which folds along fold line 415 is identical to front side wall exterior flap 110 of carton embodiment 10, with the exception that it includes a gripping tab 480 hingedly secured to its free edge. Rear side wall 450 differs from rear side wall 50 of carton embodiment 10 in that no line of perforations 180 is provided therein.

Rear side wall interior flap 570 differs from rear side wall interior flap 70 on carton embodiment 10 in that the line of weakness defining the shear initiating portion 490 of interior flap 570 comprises lines of perforation 460 and 470 extending in a direction generally parallel to the application of compressive forces and line of perforations 465 which serves to interconnect lines of perforation 460 and 470 along folding line 476. Exterior flap 410 is secured to interior flap 470 along adhesive receiving area 550 by means of a suitable adhesive 552, as generally shown in FIG. 5. After closure of exterior flap 410, hingedly connected tab 480 is preferably secured to the outermost surface of the rear side wall 450 of the carton, as by an adhesive 552 applied along adhesive receiving ares 650.

As will be apparent from the foregoing description, opening of the carton embodiment 310 illustrated in FIG. 5 is generally similar to that shown in FIG. 4. However, opening is effected by lifting the unsecured edge of tab 480, breaking the adhesive bond in area 650 and thereafter continuing to lift upwardly on exterior flap 410 by gripping and lifting upwardly on tab 480. This causes separation between rear side wall 450 and interior flap 570 along line of perforations 465 located in fold line 476 and rupture of interior flap 570 along that portion of the line of weakness formed by lines of perforation 460 and 470. In addition, it initiates delamination of interior flap 570 in those areas of the non-shear initiating portions of the flap which are secured to exterior flap 410 by means of adhesive 552. The net result is much the same as that generally illustrated in FIG. 4, with the exception that the entire rear side wall 450 of the carton 310 remains integral.

Figure 6:
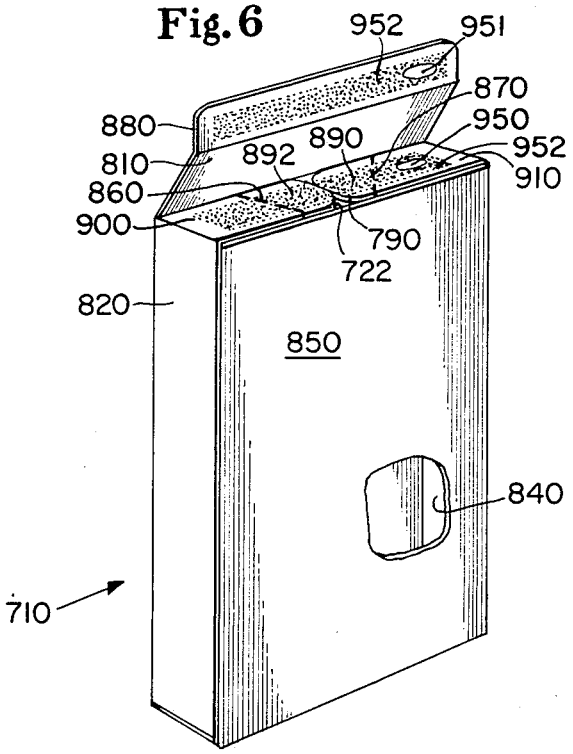
FIG. 6 is a simplified perspective illustration of still another embodiment of the present invention.

Still another embodment of the present invention is disclosed in FIG. 6. In the embodiment 710 illustrated in FIG. 6, only the edge side walls, i.e., edge side walls 820 and 840, are provided with flaps, i.e., flaps 722 and 790, respectively. The shear initiating portion of each flap comprises its innermost edge, i.e., innermost edges 890 and 892, while the non-shear initiating portion of each flap comprises that portion located intermediate those portions of the line of weakness located in the edge side wall flaps, i.e., lines of perforation 860 and 870, and the edge side wall to which said flap is hingedly connected. In the case of embodiment 710, it will be noted that it is unnecessary to interconnect the lines of perforation 860 and 870 by means of a line of perforations at the uppermost edge of rear side wall 850, since the edge side wall flaps 722 and 790 are not hingedly connected to the rear side wall. Thus the interconnecting portion of the line of weakness normally provided at the point of intersection between the rear side wall and the interior flap hingedly connected thereto in the carton embodiments illustrated in FIGS. 1 through 5 is inherent in the construction of carton embodiment 710.

Rear side wall exterior flap 810 is in most respects similar to rear side wall flaps 110 and 410 utilized in the carton embodiments 10 and 310 shown in FIGS. 1–4 and 5, respectively, with the exception that the free edge of exterior flap 810 is provided with a tab 880 extending across the full width of the carton. Exterior flap 810 is preferably secured to the outermost surface of interior flaps 722 and 790 in the areas coinciding with adhesive receiving area 950 by means of a suitable adhesive 952. Tab 880 is preferably secured to rear side wall 850 of carton embodiment 710 in those areas coniciding with adhesive receiving area 951 by means of a suitable adhesive 952.

Opening of the carton embodment 710 illustrated in FIG. 6 is carried out by grasping tab 880 at its unsecured edge and lifting upwardly, thereby causing separation of the tab from the rear side wall 850 of the carton in its areas of securement 951. Once tab 880 has been separated from rear side wall 850 of the carton, further upward lifting causes the shear initiating portions 890 and 892 of interior flaps 790 and 722, respectively, to begin rupturing along lines of perforation 860 and 870 until such time as the areas of adhesive joinder with exterior flap 810 are encountered. At this point, delamination of the non-shear initiating portions 900 and 910 coinciding with adhesive receiving area 950 begins to take place. The end result is somewhat similar to the embodiments illustrated in FIGS. 4 and 5, with the exception that there are two shear initiating portions, i.e., portions 890 and 892, which remain adhered to the innermost surface of exterior flap 810, and the carton's cross-section is fully exposed by outwardly folding the non-shear initiating portions of the edge side wall flaps 722 and 790 which remain hingedly connected to edge side walls 820 and 840, respectively. A carton of the type generally illustrated in FIG. 6 offers the additional benefit of reclosability by merely tucking tab 880 inside of rear side wall 850.

While particular embodiments of the present invention have been illustrated and described, it will be obvious to those skilled in the art that various changes and modifications can be made without departing from the spirit and scope of the invention. It is intended to cover in the appended claims all such modifications that are within the scope of this invention.

What is claimed is:

1. A rectangular carton structure having a pair of end walls and two pairs of opposing side walls, said carton structure having, upon erection, at least one end wall comprising at least two overlapping flaps, each hingedly connected to an oppositely disposed parallel side wall of said carton structure, said at least one end wall being easily openable to provide access to the entire cross-section formed by the side walls of said carton structure yet resistant to compression applied in a direction perpendicular to the hingedly connected edges of said overlapping flaps, one of said overlapping flaps comprising an interior flap having its length oriented parallel to its hingedly connected edge and its width oriented perpendicular to its hingedly connected edge, said interior flap including a sufficient portion of a line of weakness to define a centrally located shear initiating portion spanning the entire width of said interior flap and a non-shear initiating portion adjacent each of the lateral edges of said centrally located shear initiating portion of said interior flap, the other of said overlapping flaps comprising an exterior flap hingedly connected to the side wall disposed opposite said hingedly connected edge of said interior flap, the innermost surface of said exterior flap being secured directly to the outermost surface of both the shear initiating and the non-shear initiating portions of said interior flap, whereby opening of said end of said carton is carried out by lifting upwardly on the hingedly connected edge of said shear initiating portion of said interior flap, thereby simultaneously causing complete separation between the shear initiating and the non-shear initiating portions of said interior flap along said portion of said line of weakness included in said interior flap as well as complete separation between said exterior flap and the non-shear initiating portions of said interior flap without tearing through said exterior flap.

2. The structure of claim 1, wherein the portion of said line of weakness included in said interior flap comprises a pair of discrete, laterally spaced lines of perforation, each spanning the entire width of said interior flap, said shear initiating portion of said interior flap being located intermediate said laterally spaced lines of perforation.

3. The structure of claim 1, wherein said exterior flap is adhesively secured to both the shear initiating and the non-shear initiating portions of said interior flap.

4. The structure of claim 1, wherein lifting upwardly on the hingedly connected edge of said shear initiating portion of said interior flap causes delamination of the non-shear initiating portions of said interior flap in those areas which are secured to said exterior flap during the end opening process.

5. The structure of claim 1, wherein lifting upwardly on the hingedly connected edge of the shear initiating portion of said interior flap causes severance of the means securing said exterior flap to the non-shear initiating portions of said interior flap.

6. The structure of claim 1, wherein lifting upwardly on the hingedly connected edge of said shear initiating portion of said interior flap causes delamination of said exterior flap in those areas which are secured to the non-shear initiating portions of said interior flap.

7. The structure of claim 1, wherein said interior flap and said exterior flap are substantially free of lines of weakness oriented substantially parallel to their hingedly connected edges.

8. The structure of claim 1, wherein said pairs of opposing side walls are of unequal width and said interior flap and said exterior flap are hingedly connected to the side walls of maximum width.

9. The structure of claim 1, wherein said interior flap and said exterior flap are substantially coextensive with one another as well as with the cross-section formed by the side walls of said carton structure.

10. The structure of claim 1, wherein the portion of said line of weakness included in said interior flap comprises a pair of discrete, laterally spaced lines of perforation, each spanning the entire width of said interior flap, said laterally spaced lines of perforation being interconnected to one another by a third line of perforations at the point of connection between said interior flap and the side wall to which said interior flap is hingedly connected.

11. The structure of claim 10, wherein said third line of perforations is included in the side wall of said carton to which said interior flap is hingedly connected.

12. The structure of claim 10, wherein said shear initiating portion of said interior flap is secured to the coinciding portion of said exterior flap, and opening of said carton is effected by lifting upwardly on the portion of said exterior flap coinciding with said shear initiating portion of said interior flap.

13. The structure of claim 10, wherein said third line of perforations coincides with the hinged connection between said interior flap and said side wall.

14. The structure of claim 12, wherein said exterior flap is provided with grasping means to initiate said carton opening action.

15. The structure of claim 14, wherein said grasping means comprises a tab hingedly connected to the free edge of said exterior flap.

16. The structure of claim 14, wherein said grasping means comprises a flexible member secured to the free edge of said exterior flap in the area coinciding with said shear initiating portion of said interior flap.

17. A rectangular carton structure having a pair of end walls and two pairs of opposing side walls, said carton structure having, upon erection, at least one end wall comprising at least two overlapping flaps, each hingedly connected to an oppositely disposed parallel side wall of said carton structure, said at least one end wall being easily openable to provide access to the entire cross-section formed by the side walls of said carton structure yet resistant to compression applied in a direction perpendicular to the hingedly connected edges of said overlapping flaps, one of said overlapping flaps comprising an interior flap having its length oriented parallel to its hingedly connected edge and its width oriented perpendicular to its hingedly connected edge, said interior flap including a pair of laterally spaced lines of perforation, each spanning the entire width of said interior flap, thereby defining a centrally located shear initiating portion and a pair of laterally adjacent non-shear initiating portions thereof, said laterally spaced lines of perforation included in said interior flap being interconnected to one another at the hingedly connected edge of said interior flap by means of a third line of perforations located in the side wall to which said interior flap is hingedly connected, the other of said overlapping flaps comprising an exterior flap hingedly connected to the side wall disposed opposite the side wall to which said interior flap is hingedly connected, said exterior flap being substantially coextensive with the entire cross-section formed by the side walls of said carton structure, the innermost surface of said exterior flap being secured directly to the outermost surface of both the shear initiating and the non-shear initiating portions of said interior flap, whereby opening of said end of said carton is carried out by lifting upwardly on the hingedly connected edge of said shear initiating portion of said interior flap, thereby simultaneously causing complete separation between the shear initiating and the non-shear initiating portions of said interior flap along said laterally spaced lines of perforation included in said interior flap as well as complete separation between said exterior flap and the non-shear initiating portions of said interior flap without tearing through said exterior flap.

18. The structure of claim 17, wherein lifting upwardly on the hingedly connected edge of said shear initiating portion of said interior flap causes delamination of the non-shear initiating portions of said interior flap in those areas which are secured to said exterior flap during the end opening process.

19. The structure of claim 17, wherein said interior flap and said exterior flap are substantially free of lines of weakness oriented substantially parallel to their hingedly connected edges.

* * * * *

UNITED STATES PATENT AND TRADEMARK OFFICE

CERTIFICATE OF CORRECTION

PATENT NO. : 4,865,204

DATED : September 12, 1989

INVENTOR(S) : GERALD E. VANCE

It is certified that error appears in the above-identified patent and that said Letters Patent is hereby corrected as shown below:

In the Abstract, line 5, "higedly" should read -- hingedly -- .

In the Abstract, line 8, after "of" insert -- the -- .

Column 1, line 32, "ar" should read -- are -- .

Column 3, line 24, "simplfied" should read -- simplified -- .

Column 4, line 25, "fist" should read -- first -- .

Column 4, line 34, after "Delaware" insert -- , -- .

Column 4, line 42, "30" should read -- 80 -- .

Column 4, line 45, "130" should read -- 80 -- .

Column 5, line 3, "structure" should read -- structures -- .

Column 5, line 43, "interor" should read -- interior -- .

Column 5, line 61, "lwhich" should read -- which -- .

Column 6, line 59, "ares" should read -- areas -- .

Drawing Figure 2, reference numeral "130" should read -- 80 -- .

Signed and Sealed this

Thirteenth Day of March, 1990

*Attest:*

JEFFREY M. SAMUELS

*Attesting Officer*

*Acting Commissioner of Patents and Trademarks*